US005477912A

United States Patent [19]

Cisko et al.

[11] Patent Number: 5,477,912

[45] Date of Patent: Dec. 26, 1995

[54] ROLL FOR USE IN A BELT CASTER AND AN ASSOCIATED METHOD

[75] Inventors: Lawrence W. Cisko, Irwin; Albert C. Wang, Murrysville; S. John Pien, Export; Adam J. Sartschev, Allison Park, all of Pa.

[73] Assignee: Aluminum Company of America, Pittsburgh, Pa.

[21] Appl. No.: 128,590

[22] Filed: Sep. 28, 1993

[51] Int. Cl.[6] ..... B22D 11/06

[52] U.S. Cl. ..... 164/481; 164/432; 492/6; 492/15; 492/39

[58] Field of Search ..... 164/481, 432, 164/431, 435; 492/39, 40, 5, 16

[56] References Cited

U.S. PATENT DOCUMENTS

| | | | |
|---|---|---|---|
| 2,640,235 | 6/1953 | Hazelett | 164/481 |
| 3,104,608 | 9/1963 | Ribbans, III . | |
| 3,310,849 | 3/1967 | Hazelett et al. | 164/432 |
| 3,386,149 | 6/1968 | Robertson | 492/6 |
| 3,478,555 | 11/1969 | Achler et al. | 492/39 X |
| 3,871,905 | 3/1975 | Petry . | |
| 3,878,883 | 4/1975 | Hazelett et al. . | |
| 4,002,197 | 1/1977 | Hazelett et al. . | |
| 4,537,243 | 8/1985 | Hazelett et al. . | |
| 4,552,201 | 11/1985 | Wood . | |
| 4,601,324 | 7/1986 | Artz et al. . | |
| 4,632,176 | 12/1986 | Pearce | 164/481 |
| 4,921,037 | 5/1990 | Bergeron et al. . | |
| 4,958,558 | 9/1990 | Harreither . | |
| 4,964,456 | 10/1990 | Lauener . | |

FOREIGN PATENT DOCUMENTS

| | | | |
|---|---|---|---|
| 63-43743 | 2/1988 | Japan | 164/481 |
| 1-148441 | 6/1989 | Japan . | |
| 1-181950 | 7/1989 | Japan | 164/431 |
| 2-211945 | 8/1990 | Japan . | |

OTHER PUBLICATIONS

Abstract of Japanese Patent Publication 1–148441 Published Jun. 9, 1989.

Abstract of Japanese Patent Publication 2–211945 Published Aug. 23, 1990.

*Primary Examiner*—J. Reed Batten, Jr.

*Attorney, Agent, or Firm*—David V. Radack; William J. O'Rourke, Jr.

[57] ABSTRACT

A roll for use in a belt caster. The roll has a plurality of axial segments, at least one of which can be adjusted to compensate for transverse distortions in the belt. Generally uniform tension is maintained transversely in the belt so that the belt remains generally planar in the portion that contacts the molten metal that is cast in the belt caster.

44 Claims, 7 Drawing Sheets

ROLL FOR USE IN A BELT CASTER AND AN ASSOCIATED METHOD

BACKGROUND OF THE INVENTION

This invention relates to a roll for use in a belt caster and an associated method and more particularly to a roll having a plurality of segments that are adapted to move in order to compensate for distortions in the belt.

Belt casters are well known to those skilled in the art. More particularly, twin belt casters are used to continuously cast metal products directly from molten metal in a casting region or solidification zone defined between spaced portions of a pair of revolving, flexible casting belts which are moved along with the metal being cast. Such casters can be oriented in a generally horizontal or generally vertical direction or can be angularly disposed. See, generally, U.S. Pat. No. 4,552,201 and other patents cited therein (horizontal twin belt casters) and U.S. Pat. No. 4,964,456 (vertical twin belt caster).

In order to continuously cast the molten metal into a metal product, it is critical that the belts remain substantially flat in the solidification zone. Non-planar belts create non-uniform transverse contact with the solidifying slab thus in turn causing degradation in slab quality. This degradation in slab quality causes further belt distortion itself. Thus, it can be seen that once the belt becomes non-planar, slab quality is difficult, if not impossible to maintain.

There have been several solutions proposed for the non-planar belt problem. U.S. Pat. No. 4,552,201 provides a belt-support system including back-up rollers which shape and maintain the casting region. U.S. Pat. No. 4,964,456 discloses stretching the belt past its elastic limit whereby the belt is strained to the extent that a contraction of its cross-sectional area takes place to counteract its thermal expansion, thus resisting buckling. Finally, others have suggested pretreating the belt surface (U.S. Pat. No. 3,871,905) or preheating the belts prior to their entering into the solidification zone (U.S. Pat. Nos. 4,002,197 and 4,537,243).

There are various problems and shortcomings associated with each of these prior art solutions. Thus, there remains a need for an apparatus that facilitates maintaining the belt in a twin belt caster in a planar position in the solidification zone.

SUMMARY OF THE INVENTION

The roll for use in a belt caster has met the above need. A roll in accordance with the invention has a plurality of axial segments and means for adjusting the position of the axial segments to compensate for transverse distortions in the belt. In this way, generally uniform transverse tension is maintained in the belt so that the belt remains generally planar in the solidification zone.

The adjustment means preferably consists of a shaft on which the axial segments are mounted, the shaft having at least one portion which is operatively associated with each segment. The portion is adapted to move radially relative to the shaft. This radial movement will cause responsive radial movement of the axial segment relative to the shaft.

It is an object of the invention to provide a roll which will insure uniform transverse belt tension.

It is a further object of the invention to provide a roll that can be used in association with a twin belt caster.

It is yet another object of the invention to provide a twin belt caster in which the belt is kept planar in the solidification zone.

It is a further object of the invention to continually vary the transverse length of the casting belt yet eliminate transverse tension variation.

It is still another object of the invention to provide a roll which can be used to maintain the flatness of any type of web, such as paper and plastic sheets.

It is another object of the invention to provide an axially segmented roll that can be used to steer the belt.

It is another object of the invention to provide an axially segmented roll that can be used to drive the belt.

These and other objects of the invention will become more readily apparent as the following detailed description of the preferred embodiments proceeds.

DETAILED DESCRIPTION

As used herein, whenever the name of a metal is used, such as aluminum, that name is deemed to include alloys of that particular metal. Also, as used herein the term "metal products" means castings made of metal.

Figure 1:
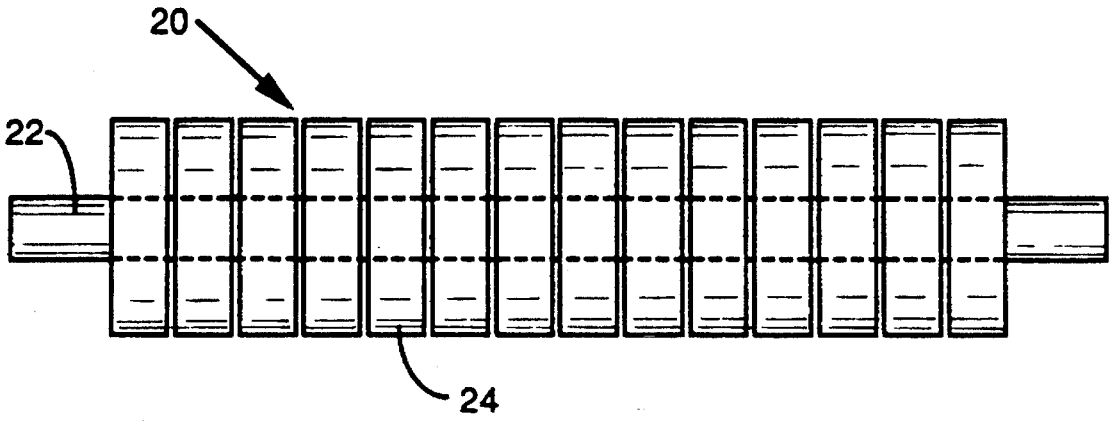
FIG. 1 is an elevational view of a roll embodying the invention.
Figure 1A:
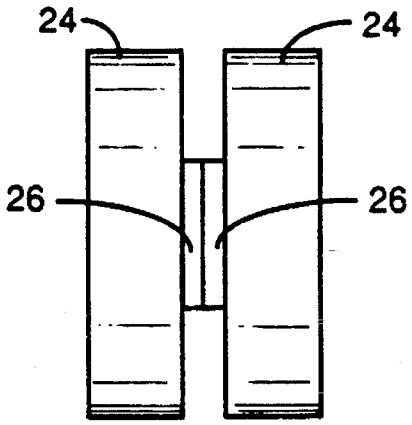
FIG. 1A is a detailed view of the linear bearing means disposed between the axial segments of the roll.

Referring to FIG. 1, a roll 20 embodying the invention is shown. The roll 20 consists of a fixed shaft member 22 upon which are mounted a plurality of axial segments, such as axial segment 24. FIG. 1 shows a total of fourteen axial segments although it will be appreciated that a different number of axial segments can be employed depending on the width of each axial segment itself and the width of the belt with which the roll is used. In one embodiment, for example, the roll 20 can be used with an eighty inch belt and thus the axial segments can have a width of six inches although it will be appreciated that different numbers of and widths for the axial segments 24 can be provided. As can be seen in FIG. 1A, the axial segments 24 are separated by linear bearing means 26 associated with each segment. The linear bearing means 26 can be made of hard bronze and are configured to produce a gap of about 0.010–0.020 between the rotating portion of each of the axial segments.

Figure 2:
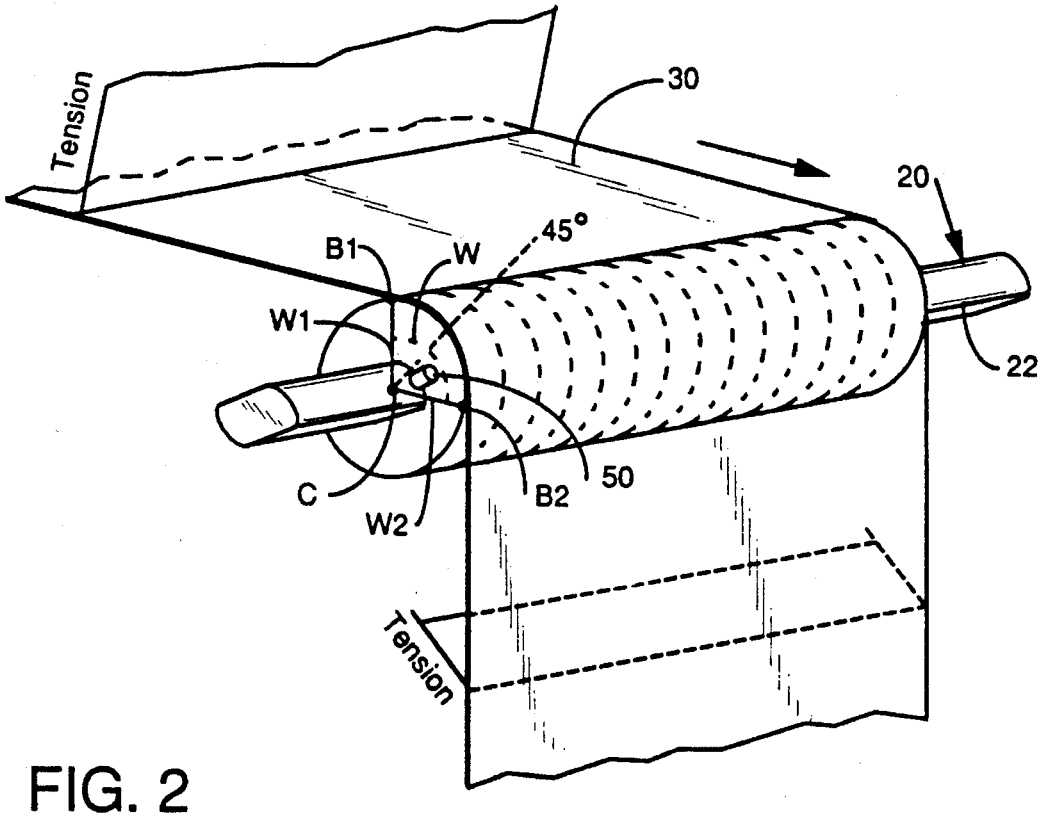
FIG. 2 is a perspective view showing a casting belt in contact with the roll and graphs representing the transverse tension on the belt.

The shaft 22 is rigidly mounted to the caster frame and the belt 30 engages the outer surface of the axial segments as is shown in FIG. 2. FIG. 2 also shows a graph, which plots the local tension of the belt on the y-axis, with the x-axis representing the point on the belt at which the tension is measured. As can be seen, with a roll 20 in operation, different local tensions are present across the transverse length of the belt 30. These different local tensions cause buckling and deformation of the belt 30, resulting in the belt 30 being non-planar in the solidification zone of the belt caster. This invention is designed to even out the tensions by providing a plurality of axial segments 24 that adjust automatically in response to differential local belt tensions. As can be seen in FIG. 2, the belt tensions are more even after the belt 30 has passed roll 20 and thus the belt 30 is flat.

Figure 3:
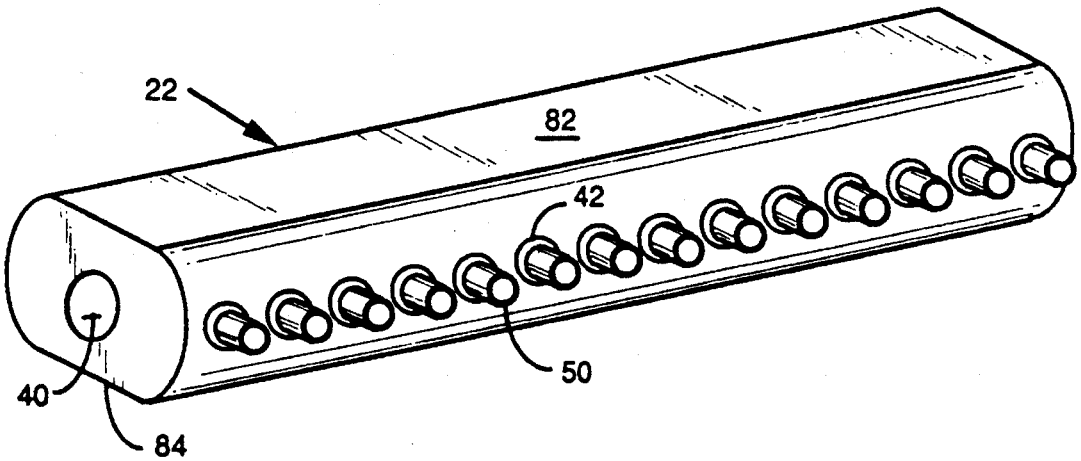
FIG. 3 is a perspective view of the shaft of the roll, showing the plurality of movable portions.

Referring to FIGS. 3–6, the adjustment means described in general above will be discussed in detail. Referring particularly to FIG. 3, the shaft 22 of the roll 20, without the axial segments mounted thereon is shown. The shaft 22 is preferably made of steel and defines a generally cylindrical hydraulic manifold 40 and a plurality of holes, such as hole 42. The number of holes corresponds to the number of axial segments 24 on the roll 20, which in the case of roll 20, means that there are fourteen holes. The holes are preferably disposed so that each one is associated with one and only one axial segment.

Referring further to FIG. 3, it can be seen that pistons, such as piston 50 are disposed in the holes. The pistons are preferably shaped as cylinders and are preferably made of a suitable engineering material, such as steel. The pistons are sized such that they are locationally fit into the holes and are able to move radially in the holes by the exertion of pressure from hydraulic fluid in the hydraulic manifold, as will be explained hereinbelow with respect to FIGS. 4–6. The pistons 50 are adapted to move radially a distance which depends on the length of the holes and the length of the piston.

Referring back to FIG. 2, the shaft 22 of the roll 20 is located such that the pistons move radially on a line which generally bisects the "wrap angle" W shown in FIG. 2. The wrap angle W, as is known to those skilled in the art, is formed by two lines W1 and W2, W1 being a line drawn from the center C of the shaft 22 to the point B1 where the belt 30 first contacts the roll 20 and line W2 which is a line drawn from the center of the shaft C to the point B2 where the belt lasts contacts the roll. As shown in FIG. 2, the wrap angle W is approximately 90°, therefore, the shaft 22 is positioned so that the pistons 50 project radially from the shaft at about 45°. This positioning insures that the pistons 50 will produce the maximum displacement of the belt 30 per each unit of incremental radial movement of the piston 50.

Figure 4:
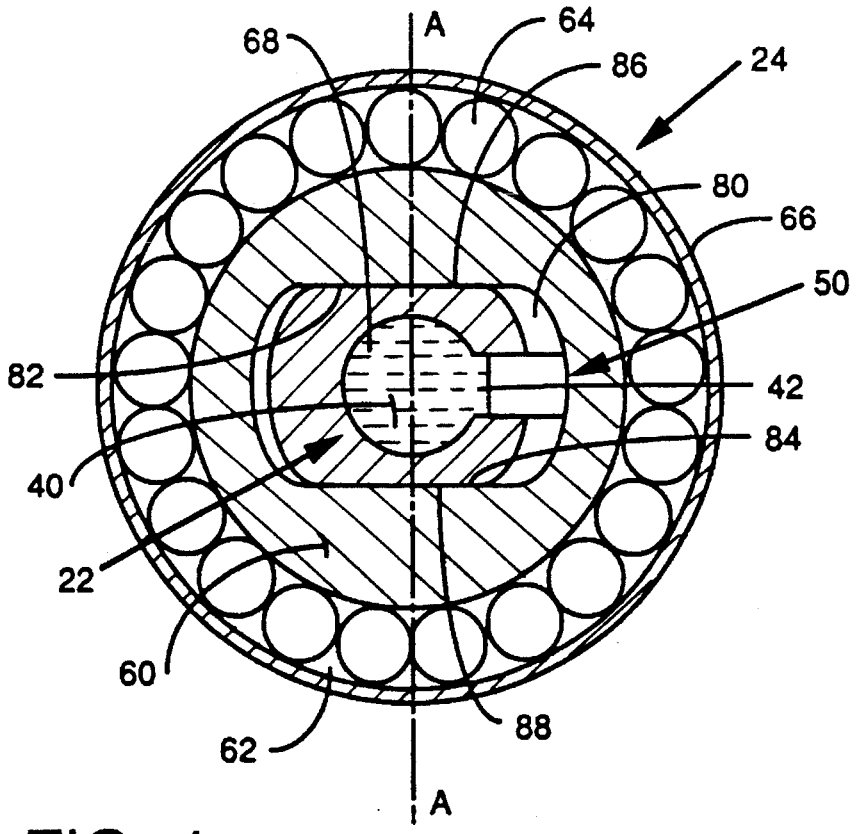
FIG. 4 is a vertical section taken through one of the axial segments of the roll.

Referring now to FIG. 4, a vertical section through axial segment 24 mounted on the shaft 22 is shown. The shaft 22 defines the generally circular in cross-section hydraulic manifold 40 and the hole 42 in which piston 50 is fit. The piston 50 bears against an inner fixed race 60, preferably made of steel, on which an outer rotatable race 62 is mounted. The rotatable race 62 consists of a plurality of rotatable rollers 64 which are enclosed in a substantially non-deformable, generally cylindrical outer shell 66. The rotatable rollers 64 bear against and rotate relative to the inner race 60 and because they are in contact with the outer shell 66, will allow responsive rotation of the outer race 62 with the belt 30.

In operation, hydraulic fluid 68 supplied to the hydraulic manifold 40 at a constant pressure provides a fluid pressure against the piston 50, causing it to move radially and contact the inner race 60. The hydraulic fluid 68 is supplied by a suitably configured constant pressure hydraulic fluid system 70 shown schematically in FIG. 5. The hydraulic fluid 68 if used in a casting application, is preferably a fire resistant fluid such as a phosphate ester.

Referring back to FIG. 4, it will be appreciated that the center line of the hydraulic manifold and of the radially movable axial segment is shown as A. In this position, a space 80 is created by the inner race 60 and the shaft 22 on the side of the shaft 22 opposite the piston 50. In this position, a predetermined and desired interfacial tension between the axial segment 24 and the belt 30 is created by the hydraulic fluid pressure on the one side of the piston 50 and the force exerted by the local belt tension on the opposite side of the piston 50. Thus, the position of the piston 50 is a function of both the hydraulic fluid pressure and the force exerted by the local belt tension.

It will also be appreciated that the shaft has preferably an upper planar section 82 and a lower planar section 84 (see also FIG. 3) which are complementary to upper section 86 and lower section 88 of the inner race 60. In this way, the axial segment can move radially with respect to the shaft as will be explained in connection with FIG. 6.

Figure 6:
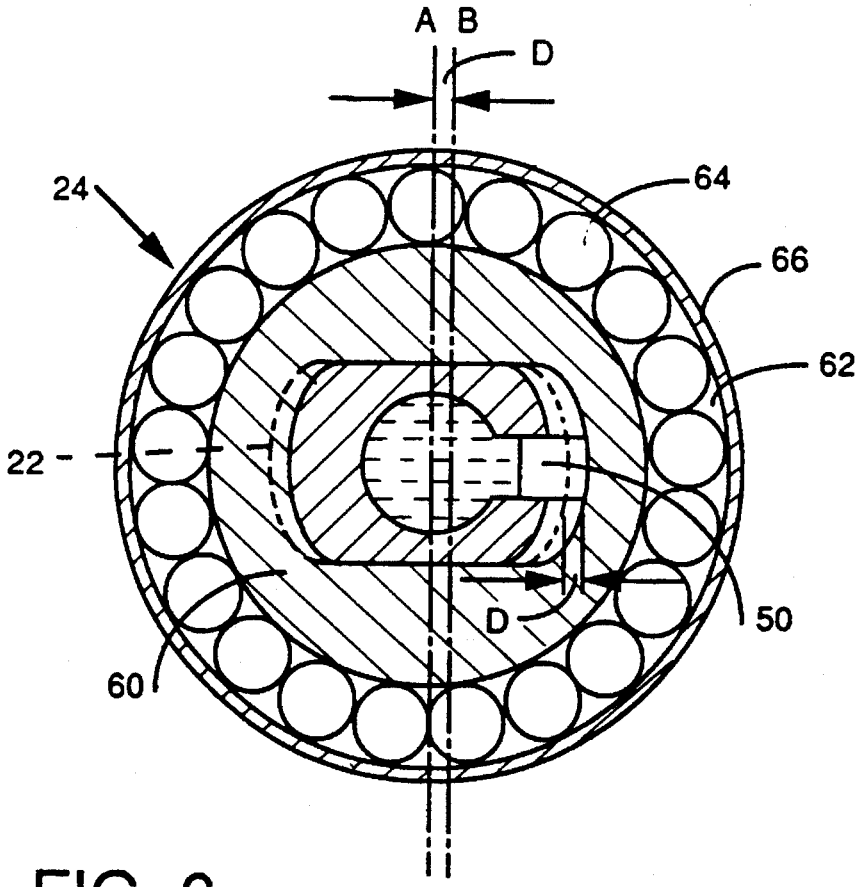
FIG. 6 is a view similar to FIG. 4 only showing the axial segment being moved radially.

Referring now to FIG. 6, it will be recalled that the position of the piston 50 is determined by the hydraulic fluid pressure and the force exerted by virtue of the local belt tension. When in operation, if the belt tension becomes slack in a local region (see FIG. 2) associated with an axial segment, the force exerted by virtue of the belt will be reduced. In this case, the hydraulic fluid pressure exerted on the piston 50 increases, thus moving the piston 50 radially outwardly from the hydraulic manifold by distance D as shown in FIG. 6. The piston 50, in turn moves the fixed race 60 from the equilibrium position (shown in phantom in FIG. 6) to the position shown in solid line on FIG. 6, the same distance D. This, in turn, moves the entire axial segment radially the distance D equal to the distance D of the radial movement of the piston 50. As can be seen in FIG. 6 the axial segment, which in equilibrium (FIG. 4) had a center line of A, now has a center line of B with the same distance D therebetween. It will be appreciated that because the shaft is fixed, it remains in the same position. In this way, the constant, predetermined and desired interfacial tension between the roll 20 and the belt 30 is continuously maintained at each local segment along the roll 20.

Figure 5:
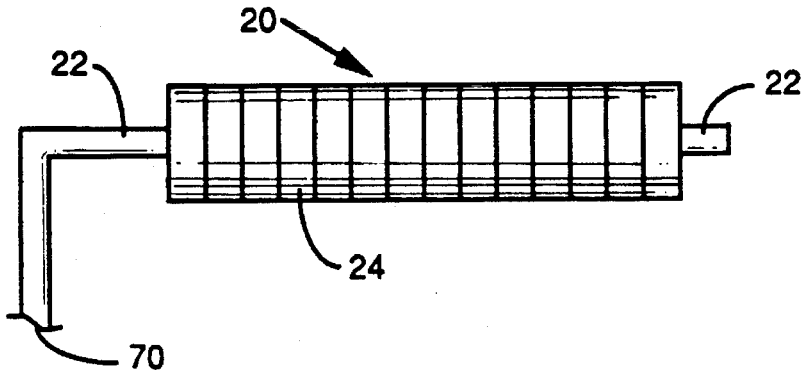
FIG. 5 is a partially schematic diagram showing the hydraulic fluid supply means.

It will be appreciated that each axial segment operates in a similar fashion to the axial segment shown in FIGS. 4–6 above. Therefore, because the hydraulic fluid exerts the same pressure on each piston, the local interfacial tensions between each axial segment of the roll 20 and its associated portion of the belt 30 are all generally equal. This, in turn, means that the length of the belt 30 does not have transverse variations, or, in other words, the belt becomes flat after passing over the roll 20 (see FIG. 2).

Figure 7:
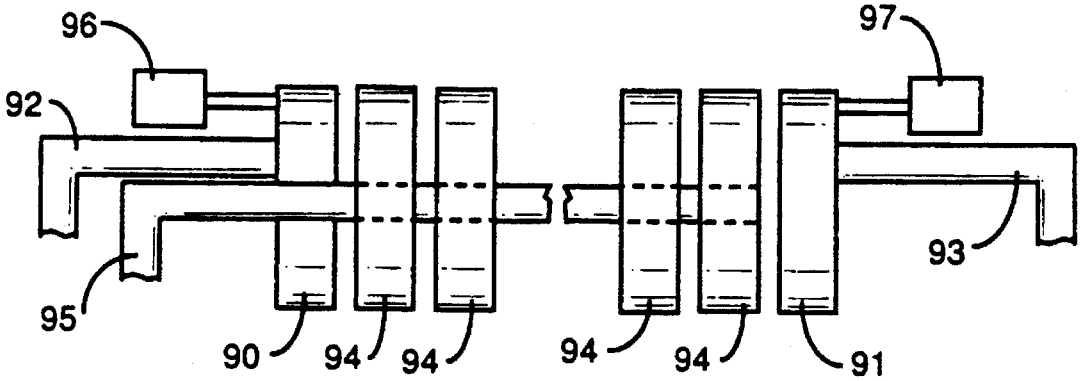
FIG. 7 is an elevational view of another embodiment of the roll of the invention.

FIG. 7 shows another embodiment of the roll of the invention in which the outer axial segments 90 and 91 are independently associated with separate hydraulic fluid supply means 92 and 93, respectively. The remaining axial segments 94 (only four of which are shown) are supplied by a third hydraulic fluid supply means 95. In this way, differential hydraulic pressures can be supplied to the outer axial segments which in turn provides for steering of the belt.

It is desired to center the belt on the roll of the belt caster. Edge sensors (not shown) which are known to those skilled in the art, indicate the position of the belt on the roll. Using the roll shown in FIG. 7, the position of the belt on the roll can be controlled. In operation, if the edge sensors detect that the belt is moving away from its centered position, one of the axial segments can be used to "steer" the belt back to its center position. For example, referring to FIG. 7, if the belt starts moving to the left towards axial segment 90, the hydraulic pressure from hydraulic pressure source means 92 can be increased thus moving the piston (not shown) associated with axial segment 92 radially outwardly and increasing the interfacial tension between the axial segment 92 and the left edge of the belt. This results in moving or "steering" the belt towards the right, or back to the desired center position. It will be appreciated that constant and continuous adjustments can be made to insure proper centering of the belt.

FIG. 7 also shows in schematic form drive means 96 and 97 associated with each of the axial segments 90 and 91, respectively. In this way, the roll can be used as a driver roll and not only as an idler roll.

Figure 7A:
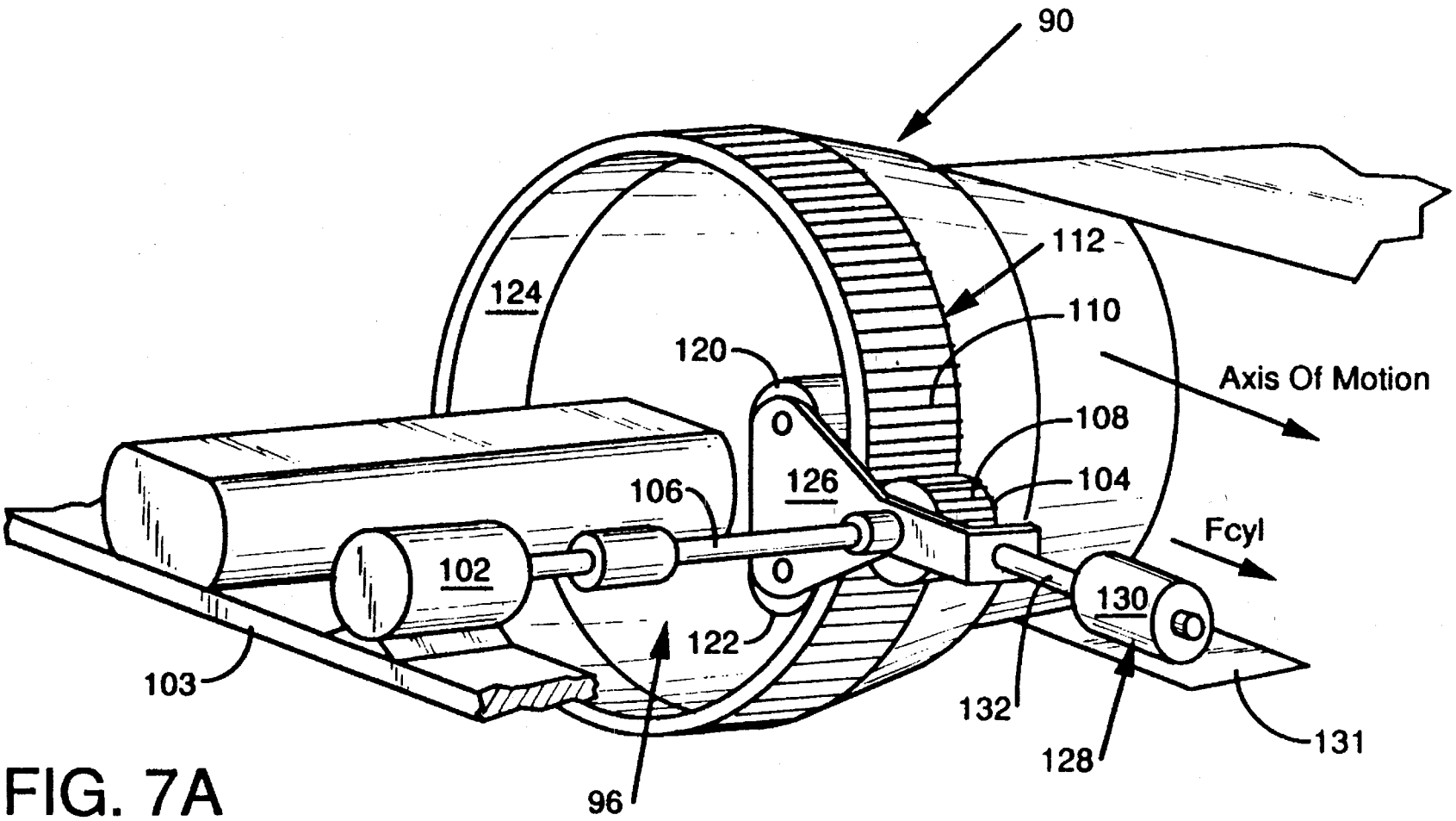
FIG. 7A is a perspective view of one of the end axial segments of the roll showing the drive means.

Referring now to FIG. 7A, the drive means of the invention will be explained in greater detail. Drive means 96 associated with axial segment 90 consists of a motor 102 or other driving means fixedly mounted on the caster frame 103, the motor 102 being connected to a pinion 104 by a universal joint coupling apparatus 106. The pinion 104 has teeth 108 which engage complementary teeth 110 of an external gear 112 mounted axially on end axial segment 90. Two offset rollers 120, 122 are provided which contact the inner surface 124 of the gear 112. The rollers 120, 122 and the pinion 104 are all mounted on a bracket 126 that is in turn secured to a cylinder means 128. The cylinder means 128 consists of fixed cylinder body 130 on a frame 131 and a movable cylinder piston 132 that is in turn secured to the bracket 126. It will be appreciated that the bracket 126 acts as an anti-torsion device that prevents the entire pinion/roller assembly from moving in any direction except the axis of motion of the axial segment 90, shown by the arrow labelled "axis of motion" on FIG. 7A. In this regard, as is known to those skilled in the art, means (not shown) can be provided on the bracket 126 to facilitate the radial movement along the axis of motion of the drive means, such as slots in the bracket 126.

The cylinder 130, which is preferably a pneumatic cylinder, provides a force in the direction indicated by the arrow labelled Fcyl. This force biases the offset rollers 120, 122 against the inner surface 124 of the gear 112 so that the pinion 104 maintains intimate contacting engagement with the teeth 110 of the gear 112, without putting undue pressure on the pinion 104 and gear 112 so as to prolong the useful life of each of them. It will be appreciated that other arrangements such as a spring biased mechanism can be used to provide this biasing force.

It will be further appreciated that because of the movement of the axial segment 90 along the axis of motion, that there will be angularity created between the pinion 104 and the motor 102, thus the need for the universal joint coupling means 106 which, as is well known to those skilled in the art, transmits rotational force between the angularly disposed motor 102 and the pinion 104.

Figure 7B:
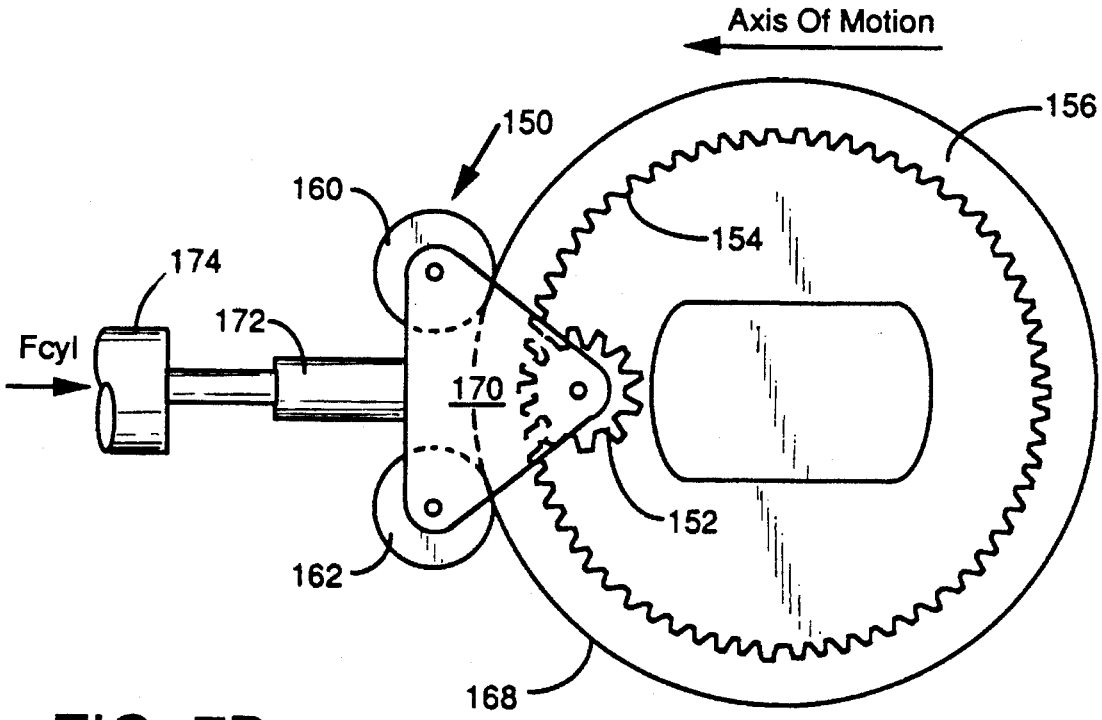
FIG. 7B is a side elevational view showing another embodiment of the drive means.

FIG. 7B shows an alternate embodiment of the drive means 150 (with the motor removed for clarity of illustration). In this embodiment, the pinion 152 is mounted to engage the teeth 154 of an internal gear 156 and the offset rollers 160, 162 are mounted to engage the external surface 168 of the axial segment 90. The rollers 160, 162 and pinion 152 are again secured to a bracket 170 which in turn is operatively associated with the shaft 172 of a cylinder 174. In this embodiment, the force of the cylinder, Fcyl is directed inwardly so as to bias the rollers 160, 162 against the external surface 168 of the axial segment 90 such that pinion 152 maintains intimate constant engagement with the teeth 154 of the gear 156.

Figure 8:
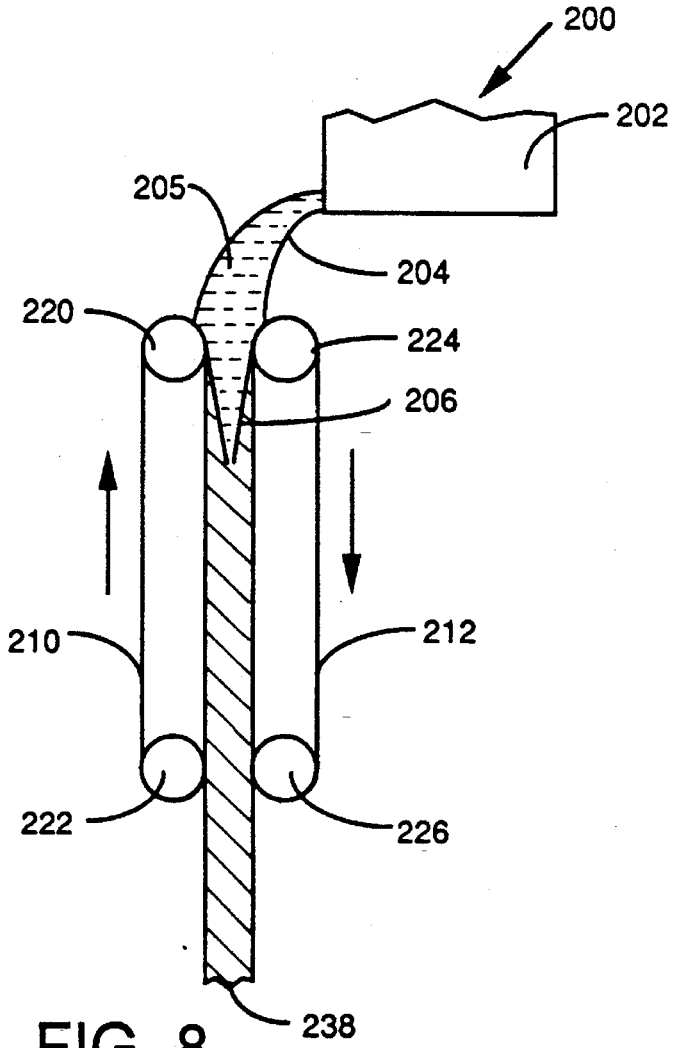
FIG. 8 is an elevational view of a vertical twin belt caster showing the location of the roll of the invention.

FIG. 8 shows a vertical twin belt caster 200 showing the position of the roll of the invention. The twin belt caster 200 consists of a molten metal supply means, such as a tundish 202, and a trough 204 which transports molten metal 205 to the casting region or solidification zone 206 of the caster 200. The molten metal 205 can be steel, aluminum, copper or any other metal capable of being cast. The belt caster 200 further consists of a pair of orbiting, endless belts 210 and 212. The belts are guided and driven by a series of rolls 220 and 222 for belt 210 and rolls 224 and 226 for belt 212. The belt caster 200 produces a cast metal product 238, such as aluminum slab or sheet. The roll of the invention is preferably used at the point where the belts 210 and 212 last contact the rolls before entering the solidification zone, or rolls 220 and 224 shown in FIG. 8, although the roll of the invention can be used in the position of rolls 222 and 226 or as all the rolls 220, 222, 224 and 226 of the belt caster 200. It will also be appreciated that the belt caster can have a third roll positioned intermediately and laterally offset away from the solidification zone 206. The roll of the invention can be used as this third roll.

Figure 9:
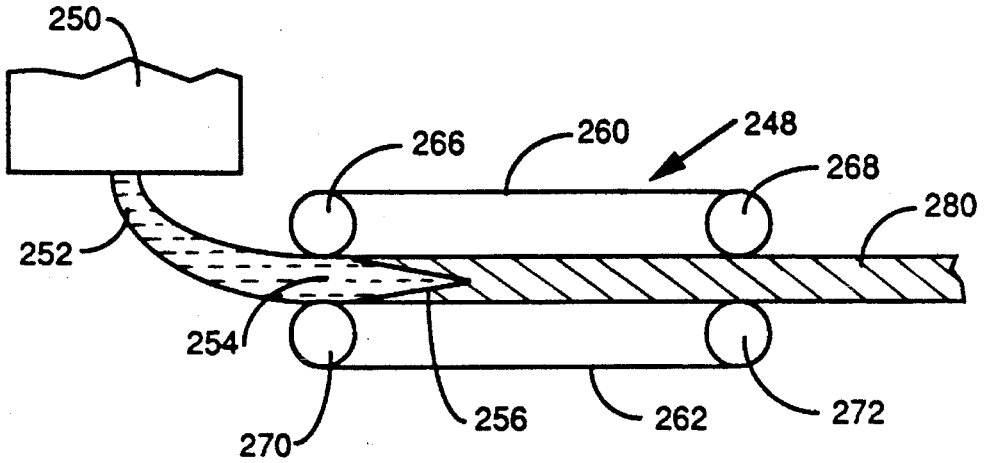
FIG. 9 is an elevational view of a horizontal twin belt caster showing the location of the roll of the invention.

FIG. 9 shows a horizontal belt caster 248 having the roll of the invention. A molten metal supply means consisting of a tundish 250 and a nozzle 252 delivers molten metal 254 to a casting region or solidification zone 256. The horizontal belt caster consists of a pair of flexible, endless orbiting belts 260, 262 which are driven and guided by rolls 266, 268 for belt 260 and rolls 270, 272 for belt 262. The roll of the invention can be any of the rolls 266, 268, 270, 272 but it is preferred that the roll of the invention is used for rolls 266 and 270 because these rolls are in contact with the belts 260, 262 just before the belts enter the solidification zone. The belt caster 248 produces a metal product 280 such as aluminum slab or sheet.

It will be appreciated that although endless belts, such as belts 210, 212 (FIG. 8) and belts 260, 262 (FIG. 9) are disclosed, the roll of the invention is not limited to use with endless belts. The roll of the invention can be used, for example, with a reusable, non-endless belt, such as that shown in U.S. Pat. No. 4,964,456, the disclosure of which is hereby incorporated by reference. Thus, any reference to the term "belt" or "revolving belt" contemplates all known embodiments of belts used in association with belt casters.

The method of the invention involves providing a twin belt caster such as that shown in FIGS. 8 or 9 having a molten metal supply means for delivering molten metal into a solidification zone and means for passing the belt through the solidification zone. A roll in accordance with the invention is provided to contact the belt. The method further consists of delivering the molten metal into the solidification zone and at least partially solidifying the molten metal in the solidification zone to produce the metal product. Simultaneously with casting the molten metal, generally uniform transverse tension is maintained in predetermined sections of the casting belt as was explained above so that the belts remain generally planar in the solidification zone.

The roll of the invention is not only useful for maintaining uniform tension transversely of a belt in a belt caster but can be used to maintain uniform tension of any web of material. For example, the roll of the invention can be used to maintain the uniform tension of the cast metal product itself (such as metal product 238 of FIG. 8) as it emerges from the belt caster. The roll of the invention can also be used to maintain the uniform tension of paper webs produced by paper making machinery, plastic sheets made by extrusion processes or any process where uniform tension of a web is a critical parameter. In any of these applications the roll of the invention can be inserted in the web handling system such that the pistons 50 project radially in a direction which bisects the wrap angle as shown in FIG. 2.

It will be appreciated that a roll for use in a belt caster and an associated method have been provided wherein the roll has a plurality of segments that move in order to compensate for distortions in the belt.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A roll for use in a belt caster employed in casting molten metal, said belt caster having a pair of movable belts which define a solidification zone in which molten metal is solidified into a metal product, said roll having a plurality of axial segments, at least one of said axial segments including a substantially non-deformable, generally cylindrical outer shell and means for adjusting the radial positioning of said at least one of said axial segments to compensate for transverse distortions in at least one of said belts, whereby generally uniform tension is maintained transversely in said belt so that said belt remains generally planar in said solidification zone.

2. The roll of claim 1, wherein said adjusting means includes a shaft on which said segments are mounted, said shaft having at least one portion operatively associated with each said segment, said portion being adapted to move radially relative to said shaft, whereby radial movement of said movable portion will cause responsive radial movement of said segment relative to said shaft.

3. The roll of claim 2, wherein said shaft defines an hydraulic manifold which contains an hydraulic fluid; and said movable portion of said shaft is moved radially in response to the pressure of said hydraulic fluid.

4. The roll of claim 3, wherein said segment includes an inner race surrounding said shaft, said movable portion being in contact with said inner race; and an outer race rotatably mounted on said inner race.

5. The roll of claim 4, wherein said outer race includes a plurality of rolling elements in rolling contact with said inner race such that said outer race can rotate relative to said inner race.

6. The roll of claim 3, wherein said hydraulic fluid is supplied to said hydraulic manifold from a hydraulic fluid source means.

7. The roll of claim 6, wherein said hydraulic fluid is supplied to said hydraulic manifold at a constant pressure, whereby approximately equal interfacial tension is maintained between said belt and said roll at each local belt area associated with each said axial segment.

8. The roll of claim 6, including said roll having a pair of end axial segments and a plurality of intermediate axial segments disposed between said end axial segments;

said hydraulic fluid source means includes (i) a first hydraulic fluid supply means supplying hydraulic fluid to one of said end axial segments; (ii) a second hydraulic fluid supply means supplying hydraulic fluid to the other of said end axial segments; and (iii) a third hydraulic fluid supply means supplying hydraulic fluid to said plurality of intermediate axial segments, whereby hydraulic fluid can be supplied to each end axial segment and said plurality of intermediate axial segments at different pressures so that said belt can be steered by said roll.

9. The roll of claim 1, including said roll having a pair of end axial segments and a plurality of intermediate axial segments disposed between said end axial segments; and drive means for rotating each of said end axial segments, whereby said roll is a driver roll.

10. The roll of claim 9, wherein said drive means includes:

a motor;

pinion means driven by said motor; and a gear secured to said end axial segment, said pinion means engaging and rotating said gear.

11. The roll of claim 10, wherein said gear has an outer circumferential surface and an inner circumferential surface; and said gear has teeth disposed on said outer surface thereof.

12. The roll of claim 11, wherein said pinion means includes:

a pinion engaging said outer circumferential surface of said gear;

at least one roller engaging said inner circumferential surface of said gear;

a bracket connecting said pinion and said roller; and biasing means operatively associated with said bracket for maintaining said pinion in intimate meshing engagement with said gear teeth.

13. The roll of claim 12, wherein said biasing means includes a pneumatic cylinder.

14. The roll of claim 10, wherein said gear has an outer circumferential surface and an inner circumferential surface; and said gear has teeth disposed on said inner surface thereof.

15. The roll of claim 14, wherein said pinion means includes:

a pinion engaging said inner circumferential surface of said gear;

at least one roller engaging said outer circumferential surface of said gear;

a bracket connecting said pinion and said roller; and biasing means operatively associated with said bracket for maintaining said pinion in intimate meshing engagement with said gear teeth.

16. The roll of claim 15, wherein said biasing means includes a pneumatic cylinder.

17. The roll of claim 10, including universal joint coupling means connecting said motor to said pinion means, whereby said motor can drive said pinion means when said pinion means is angularly displaced from said motor.

18. A roll for maintaining generally uniform tension transversely across a web, said roll having a plurality of axial segments, at least one of said axial segments including a substantially non-deformable, generally cylindrical outer shell and means for adjusting the radial positioning of said axial segments to compensate for transverse distortions in said web.

19. A roll for use in association with a belt caster having a pair of revolving belts which define a solidification zone for solidifying molten metal into metal products, said roll comprising:

a shaft defining a hydraulic manifold which contains a hydraulic fluid, said shaft having at least one portion which is movable radially in response to pressure from said hydraulic fluid in said manifold; and a plurality of axial segments mounted on said shaft, at least one of said segments being operatively associated with at least one of said movable portions of said shaft, said segment including:

an inner race surrounding said shaft, said movable portion bearing against said inner race; and an outer race rotatably mounted on said inner race, whereby movement of said movable portion will cause responsive radial movement of said segment relative to said shaft to maintain generally uniform tension transversely in said belt so that said belt remains generally planar while in use in association with said belt caster.

20. The roll of claim 19, wherein said hydraulic fluid is supplied to said hydraulic manifold from a hydraulic fluid source means.

21. The roll of claim 20, wherein said hydraulic fluid is supplied to said hydraulic manifold at a constant pressure, whereby approximately equal interfacial tension between said belt and said roll at each local belt area associated with each said axial segment is maintained.

22. A twin belt caster comprising:

a pair of revolving belts which define a solidification zone for solidifying a molten metal into a metal product;

molten metal supply means for delivering said molten metal into said solidification zone; and means for passing said belts adjacent to said solidification zone, said passing means including a roll having a plurality of axial segments and means for adjusting the position of at least one of said axial segments to compensate for transverse distortions in said belt, whereby generally uniform tension is maintained transversely in said belt so that said belt remains generally planar in said solidification zone.

23. The caster of claim 22, wherein said belts are endless belts and said passing means includes a plurality of rolls, including at least one driving roll; and at least one of said rolls is said axially segmented roll.

24. The caster of claim 23, wherein said axially segmented roll is an idler roll.

25. The caster of claim 22, wherein said twin belt caster is a generally vertical twin belt caster.

26. The caster of claim 22, wherein said twin belt caster is a generally horizontal twin belt caster.

27. The caster of claim 22, wherein said adjusting means includes a shaft on which said segments are mounted, said shaft having at least one portion operatively associated with each said segment, said portion being adapted to move radially relative to said shaft, whereby radial movement of said movable portion will cause responsive radial movement of said segment relative to said shaft.

28. The caster of claim 27, wherein said shaft defines an hydraulic manifold which contains an hydraulic fluid; and said movable portion of said shaft is moved radially in response to the pressure of said hydraulic fluid.

29. The caster of claim 28, wherein said segment includes an inner race surrounding said shaft, said movable portion being in contact with said inner race; and an outer race rotatably mounted on said inner race.

30. The caster of claim 29, wherein said outer race includes a plurality of rolling elements in rolling contact with said inner race such that said outer race can rotate relative to said inner race.

31. The caster of claim 28, wherein said hydraulic fluid is supplied to said hydraulic manifold from a hydraulic fluid source means.

32. The caster of claim 31, wherein said hydraulic fluid is supplied to said hydraulic manifold at a constant pressure, whereby approximately equal interfacial tension is maintained between said belt and said roll at each local belt area associated with each said axial segment.

33. The caster of claim 31, including said roll having a pair of end axial segments and a plurality of intermediate axial segments disposed between said end axial segments;

said hydraulic fluid source means includes (i) a first hydraulic fluid supply means supplying hydraulic fluid to one of said end axial segments; (ii) a second hydraulic fluid supply means supplying hydraulic fluid to the other of said end axial segments; and (iii) a third hydraulic fluid supply means supplying hydraulic fluid to said plurality of intermediate axial segments, whereby hydraulic fluid can be supplied to each end axial segment and said plurality of intermediate axial segments at different pressures so that said belt can be steered by said roll.

34. The caster of claim 22, including said roll having a pair of end axial segments and a plurality of intermediate axial segments disposed between said end axial segments; and drive means for rotating each of said end axial segments, whereby said roll is a driver roll.

35. The caster of claim 34, wherein said drive means includes:

a motor;

pinion means driven by said motor; and a gear secured to said end axial segment, said pinion means engaging and rotating said gear.

36. The caster of claim 35, wherein said gear has an outer circumferential surface and an inner circumferential surface; and said gear has teeth disposed on said outer surface thereof.

37. The caster of claim 36, wherein said pinion means includes:

a pinion engaging said outer circumferential surface of said gear;

at least one roller engaging said inner circumferential surface of said gear;

a bracket connecting said pinion and said roller; and biasing means operatively associated with said bracket for maintaining said pinion in intimate meshing engagement with said gear teeth.

38. The caster of claim 37, wherein said biasing means includes a pneumatic cylinder.

39. The caster of claim 35, wherein said gear has an outer circumferential surface and an inner circumferential surface; and said gear has teeth disposed on said inner surface thereof.

40. The caster of claim 39, wherein said pinion means includes:

a pinion engaging said inner circumferential surface of said gear;

at least one roller engaging said outer circumferential surface of said gear;

a bracket connecting said pinion and said roller; and biasing means operatively associated with said bracket for maintaining said pinion in intimate meshing engagement with said gear teeth.

41. The caster of claim 40, wherein said biasing means includes a pneumatic cylinder.

42. The caster of claim 35, including universal joint coupling means connecting said motor to said pinion means, whereby said motor can drive said pinion means when said pinion means is angularly displaced from said motor.

43. A method of making a metal product by continuously casting molten metal, said method comprising:

providing a twin belt caster including (i) a pair of belts which define a solidification zone; (ii) molten metal supply means for delivering molten metal into said solidification zone; and (iii) means for passing said belts through said solidification zone, said passing means including a roll having a plurality of axial segments and means for adjusting the position of each of axial segments;

delivering molten metal into said solidification zone;

at least partially solidifying said molten metal in said solidification zone to produce said metal product; and simultaneously with casting said molten metal, maintaining generally uniform tension transversely in predetermined sections of said belts so that said belts remain generally planar in said solidification zone.

44. The method of claim 43, including employing aluminum as said molten metal.

* * * * *